United States Patent [19]

Hirose et al.

[11] Patent Number: 4,815,481

[45] Date of Patent: Mar. 28, 1989

[54] APPARATUS FOR MANUFACTURING FILTER CIGARETTES

[75] Inventors: Ichiro Hirose, Tokyo; Takayoshi Sagawa, Hiratsuka; Shichisei Tani, Hiratsuka; Katsuo Kato, Hiratsuka, all of Japan

[73] Assignee: Japan Tobacco Inc., Tokyo, Japan

[21] Appl. No.: 32,515

[22] Filed: Mar. 30, 1987

[30] Foreign Application Priority Data

Jun. 25, 1986 [JP] Japan ..... 61-147165

[51] Int. Cl.[4] ..... A24C 5/47

[52] U.S. Cl. ..... 131/94

[58] Field of Search ..... 131/94

[56] References Cited

U.S. PATENT DOCUMENTS 3,306,306 2/1987 Rudszinat .
3,308,832 2/1985 Stelzer .

FOREIGN PATENT DOCUMENTS 1330951 2/1980 France .
865624 3/1976 United Kingdom .
963452 1/1977 United Kingdom .
971154 3/1983 United Kingdom .

*Primary Examiner*—V. Millin

*Attorney, Agent, or Firm*—Ladas & Parry

[57] ABSTRACT

A filter cigarette-manufacturing apparatus having a filter-supplying drum with grooves cut in its periphery, extending parallel to its axis, and spaced at equal intervals along the periphery. Two tip-bypassing drums are in rolling contact with the filter-supplying drum, and a tip-bypassing drum is in rolling contact with tip-bypassing drum. Each of these drums has similar grooves spaced along the periphery at the same intervals as those of the filter-supplying drum. Filter tips obtained by cutting a filter rod are supplied into one of the grooves of the filter-supplying drum. The tip-bypassing drums cooperate with the filter-supplying drum to bypass all the tips, except one which is transported forward by the filter-supplying drum. The other tips are finally fed from the tip-bypassing drums back to the filter-supplying drum, are spaced from the one tip by different distances defined by different numbers of grooves along the periphery of said filter-supplying drum, and then are transported forward as said filter-supplying drum rotates. As a result, the filter tips and other tips produced by cutting other filter rods are sequentially distributed into those grooves of said filter-supplying drum which are located downstream of said filter tip-bypassing drums.

6 Claims, 13 Drawing Sheets

APPARATUS FOR MANUFACTURING FILTER CIGARETTES

BACKGROUND OF THE INVENTION

The present invention relates to an apparatus for manufacturing filter cigarettes, and more particularly, to an apparatus for manufacturing filter cigarettes, which has an improved section for supplying filter tips.

Apparatuses for manufacturing filter cigarettes are known. They each comprises a filter-supplying section, a cigarette-supplying section, and a wrapping section.

Apparatuses for manufacturing filter cigarettes are known. They each comprises a filter-supplying section, a cigarette-supplying section, and a wrapping section. The filter-supplying section supplies filter tips sequentially to the wrapping section in the direction at right angles to the axes of the tips. The filter tips have been cut from one longer filter rod, and each will be used to produce two filter of two cigarettes. The cigarette-supplying section supplies pairs of cigarettes, one pair after the other, to the wrapping section in the direction at right angles to the axes of the cigarettes. In the wrapping section, each filter tip is interposed between a pair of cigarettes and aligned with these cigarettes. The tip and cigarettes are wrapped together with tip paper, thereby forming a long cigarette with the filter tip provided at the middle portion. The long cigarette is cut at the middle portion into two filter cigarettes.

In the filter-supplying section, the filter tips must be juxtaposed. Otherwise they cannot be sequentially supplied to the wrapping section. The filter-supplying section has a filter-juxtaposing mechanism comprising drums and a filter guide. The drums are provided in the same number of filter tips cut from one filter rod, and are axially aligned to one another. Each drum has grooves cut in the periphery and extending parallel to the axis of the drum. The drums can rotate in the same direction, but at different speeds, each at a speed slightly lower than that of the preceding drum. The filter tips cut from a filter rod are simultaneously applied to the drums and roll into the grooves of the drums, respectively. As the drums rotate at different speeds, the filter tip received into a groove of each drum is delayed as compared to the tip received into a groove of the preceding drum. The tips are, therefore, removed at different times from the drums at the downstream the transport path of the filter-juxtaposing mechanism. The filter guide arrange the tips, side by side, and transports them to the wrapping section.

The filter-juxtaposing mechanism is disadvantageous in some respects. First, to transport the filter tips, provided by cutting one filter rod, sequentially to the wrapping section, the drums must not only have different diameters, but also rotate around different axes. A complex drive unit is indispensable to rotate the drums. Secondly, the mechanism must have as many drums as the filter tips cut from the same filter rod. This makes the filter-supplying section inevitably large. The grooves can be cut in the periphery of each drum at shorter intervals to reduce the diameter of the drum without decreasing the rate of supplying filter tips. If this is the case, the tips are juxtaposed too closely and cannot be fed to the wrapping section at such long intervals as is desired for the process performed by the wrapping section. To supply tips at these long intervals to the wrapping section, another drums having grooves cut in its periphery at the broad intervals must be provided to transfer the tips from the tip guide to the wrapping section. A mechanism must be further provided to achieve a reliable and smooth transfer of filter tips from the tip guide to the additional grooved drum. This mechanism needs some adjustment to function, and the adjustment costs much labor. In view of this it is desired that the grooves of all drums be cut at the same intervals.

In order to manufacture cigarettes with dual filter tips, the cigarette-manufacturing apparatus must be provided with a device for producing and supplying dual filter tips to the filter-supplying section. The dual filter-producing device is designed to axially align first and second tips of different materials, to connect them, and to wrap them with paper, thus forming a dual filter rod. In the wrapping section, this dual tip is interposed between a pair of cigarettes supplied from the cigarette-supplying section, and is aligned with these cigarettes. The dual tip and cigarettes are wrapped together with tip paper, thereby forming a long cigarette. Obviously, the first and second tips must be wrapped twice with paper in order to produce a long cigarette which will be later cut into two pieces. This renders the manufacture of filter cigarettes complex, and ultimately raise the manufacture cost of filter cigarettes.

Single-piece filter rods, usually plain filter rods, or dual filter rods, each usually consisting of a plain filter tip portion and a charcoal filter tip portion, alternately, are supplied from the filter-producing device to the filter-supplying section on an air stream. Therefore, the number of rods which can be supplied to filter-supplying section per unit time greatly depends on the weight of each rod. In short, the lighter the rod, the more rods. Dual filter rods, each composed of a charcoal tip portion and a plain tip portion, are heavier than plain rods. It follows that dual-filter cigarettes cannot help but be manufactured with a lower efficiency than the plain-filter cigarettes.

SUMMARY OF THE INVENTION

It is accordingly one object of the present invention to provide an apparatus for manufacturing filter cigarettes, whose filter-supplying section includes a filter-juxtaposing mechanism simple in structure and easy to control.

Another object of the invention is to provide an apparatus for manufacturing filter cigarettes, which needs no device for producing dual filter tips in order to manufacture dual-filter cigarettes, and which can manufacture both plain-filter cigarettes and dual-filter cigarettes with a high efficiency.

According to one aspect of this invention, there is provided an apparatus for manufacturing filter cigarettes which comprises a filter-supplying section and a wrapping section. The filter-supplying section includes a filter-supplying mechanism. This mechanism comprises a filter-transporting drum and a set of filter-bypassing drums. The filter-transporting drum has grooves cut in its periphery at predetermined intervals and extending parallel to the axis of the drum. This drum is designed to receive every grooves and to transport the filter tips toward the wrapping section as it rotates in a prescribed direction. The filter-bypassing drums form a filter-juxtaposing mechanism and are directly or indirectly in rolling contact with the filter-transporting drum. Each of them has grooves cut in the periphery at the same intervals as in the periphery of the filter-transporting drum. The filter-bypassing drums are rotated at the same circumferential speed as the filter-transporting drum. They cooperate to remove, from the filter-transporting drum, all filter tips, but one, supplied to the filter-transporting drum, and to ultimately feed the filter tips back into the grooves of the filter-transporting drum. In other words, the filter-bypassing drums define filter by-passes for every filter tip removed from the filter-transporting drum. The lengths of these by-passes are such that the filter tips cut from a filter rod and the filter tips cut from the next filter rods are alternately fed back into all those grooves of the filter-transporting drum which are located downstream of the filter by-passes.

The filter-juxtaposing mechanism, comprised of the filter-bypassing drums, can therefore feed the filter tips back into those grooves of the filter-transporting drum which are located downstream of the filter bypasses.

The apparatus described above is designed to manufacture plain filter cigarettes. According to another aspect of the present invention, there is provided an apparatus designed to manufacture dual filter cigarettes. This apparatus also comprises a filter-supplying section and a wrapping section. The filter-supplying section includes two filter-supplying mechanisms of the type similar to the mechanism used in the apparatus for manufacturing plain filter cigarettes. The first filter-supplying mechanism is used to supply filter tips of a first kind (hereinafter called "first tips") to the wrapping section, and the second filter-supplying mechanism is used to supply filter tips of a second kind (hereinafter called "second tips") to the wrapping section. The first filter-supplying mechanism are used in combination with a tip-cutting/separating mechanism. The tip-cutting-/separating mechanism cuts every first tip, that has been supplied from the filter-bypassing drums of the first filter-supplying mechanism, into two pieces, and then sets these pieces apart, leaving a predetermined gap between them. The apparatus further comprises a filter-juxtaposing drum. Like the filter-transporting drum of either filter-supplying mechanism, this drum has grooves cut in its periphery. The filter-juxtaposing drum is so positioned as to receive, in each groove, a pair of pieces cut from one first tip supplied from the tip-cutting/separating mechanism, and also to receive a second tip from the second filter-supplying mechanism into the gap between the two halves of the first tip. Hence, the filter-juxtaposing drum can supply units each consisting of two halves of the first tip and one second tip interposed between the two halves, one unit after another, to the wrapping section of the apparatus. In the wrapping section, dual filter cigarettes are produced in the same way as in the wrapping section of the conventional apparatus.

The apparatus for manufacturing dual filter cigarettes can produce plain filter cigarettes as well, only if it is slightly modified. More specifically, the first and second filter-supplying mechanisms are so driven that the first and second tips are alternately supplied to the filter-juxtaposing drum and roll into the alternate grooves thereof. To achieve this specific supply of the first and second tips, it suffices to change the number of filter-bypassing drums used in either filter-supplying mechanism and also the diameters of these filter-bypassing drums.

DETAILED DESCRIPTION OF THE PREFERRED EMBODIMENTS

A first embodiment of the invention, i.e., an apparatus for manufacturing dual filter cigarettes, will now be described with reference to FIGS. 1 to 9 attached hereto.

Figure 1:
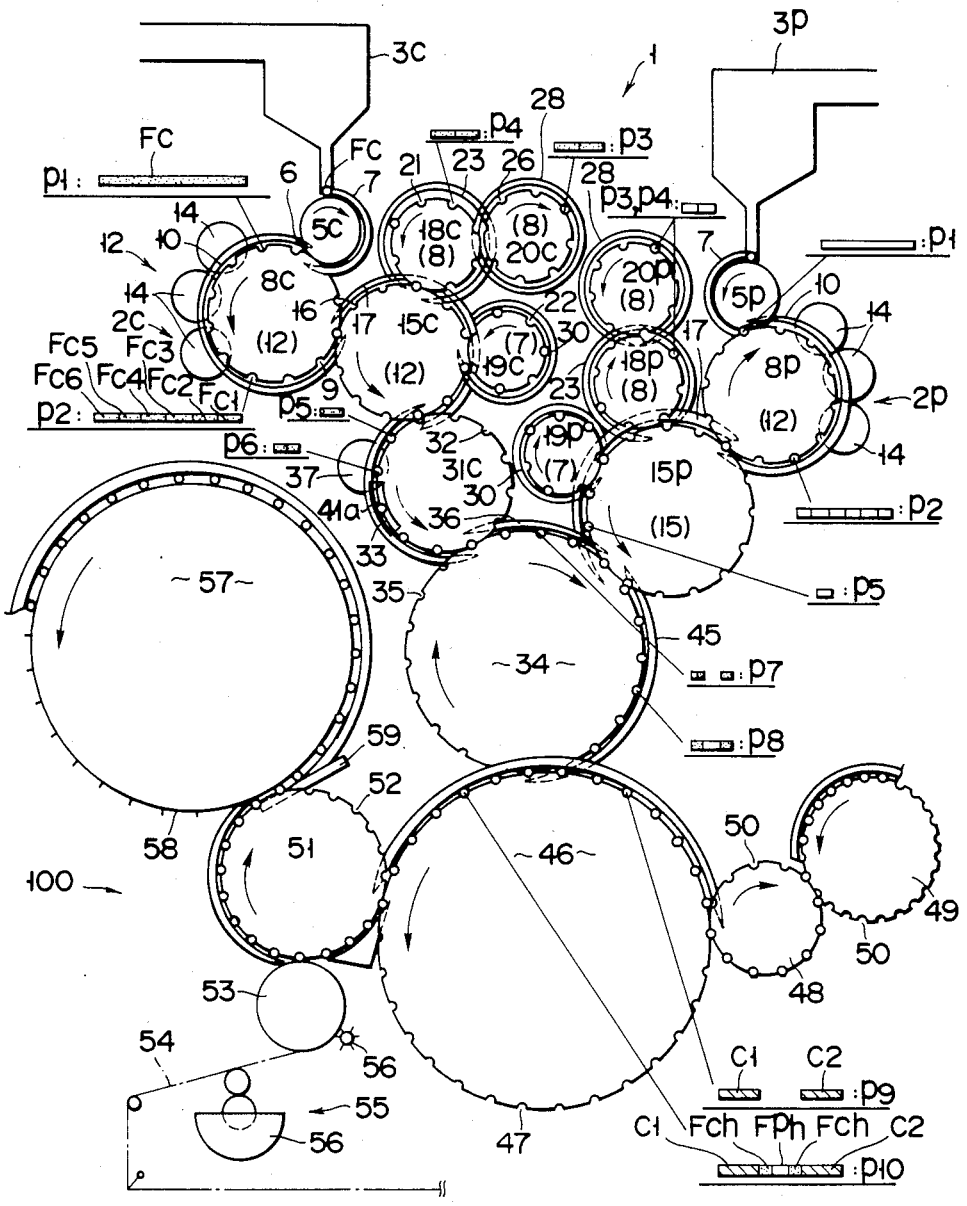
FIG. 1 is a shematic view showing the major components of a filter cigarette-manufacturing apparatus according to a first embodiment of the present invention.

As is shown in FIG. 1, this apparatus comprises filter-supplying section 1 and wrapping section 100 located below filter-supplying section 1.

Filter-supplying section 1 comprises first filter-supplying mechanism 2c and second filter-supplying mechanism 2p, which are similar in structure.

First filter-supplying mechanism 2c has hopper 3c. Hopper 3c contains a number of charcoal filter rods Fc having a prescribed length. These filter rods Fc have been produced by a device(not shown) for manufacturing charcoal filter, and have been supplied to hopper 3c, on an air stream, through a supply duct connecting the filter-manufacturing device and hopper 3c.

Filter-supplying drum 5c is provided right below the outlet of hopper 3c. This drum 5c has one groove 6 cut in its periphery and extending parallel to its axis. Groove 6 is so shaped that a charcoal filter rod Fc is removed from hopper 3c and held in groove 6 as filter-supplying drum 5c rotates clockwise as is shown in FIG. 1 by the arrow. Therefore, as drum 5c continuously rotates, it supplies filter rods Fc from hopper 3c. Charcoal filter rods Fc roll down along the inner periphery of arcuate guide 7 which surrounds the right half of drum 5c. In order to make it easier for drum 5c to taked filter rods Fc from hopper 3c, rods Fc are arranged side by side within hopper 3c.

Grooved drum 8c is provided below filter-supplying drum 5c in rolling contact therewith. Drum 8c has twelve grooves 9 cut in its periphery and extending parallel to its axis. Grooves 9 have a half-circular cross section, the radius of which is substantially the same as that of filter rods Fc. Grooved drum 8c can rotate at the same circumferential speed as filter-supplying drum 5c, in the counterclockwise direction, as is shown in FIG. 1 by the arrow. Drums 5c and 8c have such diameters that, as they rotate in the opposite directions, groove 6 of drum 5c comes into alignment with every sixth groove of drum 8c. Hence, charcoal filter rod Fc is transferred from groove 6 of drum 5c into groove 9 of drum 8c when these grooves are aligned. Filter rod Fc, now held within groove 9, is farther transported as grooved drum 8c rotates counterclockwise, while being guided by arcuate guide 10 which surrounds part of the periphery of drum 8c.

Figure 2:
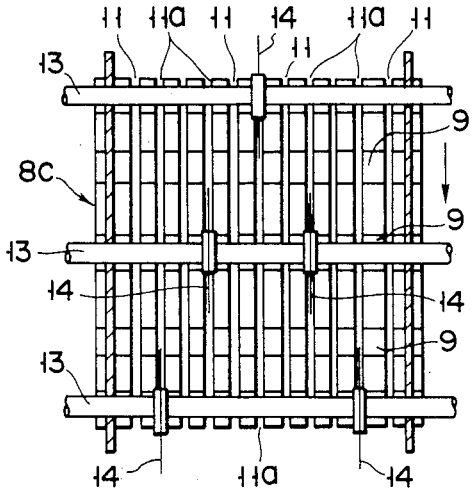
FIG. 2 is a plan view showing the positional relation between the circular blades used in the apparatus of FIG. 1, on the one hand, and a grooved drum also used in the apparatus, on the other.

As is shown in FIG. 2, annular grooves 11 are cut in the peripheries of drum 8c and extend in the circumferential direction thereof. Arcuate guide 7 has six fingers (not shown) protruding from its lower end. Arcuate guide 10 has six fingers (not shown) protruding from the upper and twelve fingers (not shown) protruding lower ends. The fingers of guide 7 protrude into annular grooves 11 of drum 8c, but do not contact the bottom or side walls of these annular grooves. Similarly, the fingers extending from the upper end of guide 10 protrude into annular grooves 11 of drum 5c, but do not contact the bottom or side walls of these annular grooves. Hence, as is shown in FIG. 1, the fingers of guide 7 and those of guide 10 overlap at the contacting point of drums 5c and 8c. This ensures the smooth transfer of charcoal filter rods Fc from drum 5c to drum 8c.

Filter-cutting mechanism 12 is provided outside arcuate guide 10. As is shown in FIGS. 1 and 2, this mechanism 12 comprises three parallel shafts 13 and five circular blades 14. Shafts 13 are rotatably supported by a pair of supports (not shown). They extend parallel to the axis of grooved drum 8c and set apart from each other along the circumference of drum 8c at angular intervals. They can be rotated by a drive means (not shown, either) in the same direction. Of five circular blades 14, one is mounted on the upper shaft 13, two are mounted on the intermediate shaft 13, and the remaining two are mounted on the lower shaft 13. Circular blades 14 have such a diameter that their peripheral edges are passed in the slits (not shown) cut in arcuate guide 10 and inserted in annular grooves 11a cut in the periphery of drum 8c and extending in the circumferential direction thereof. Annular grooves 11a are deeper than grooves 9. Hence, the edges of blades 14 completely intersect grooves 9. As is clearly shown in FIG. 2, each groove 11a is provided between any tow adjacent annular grooves 11. Grooves 11a have a width greater than the thickness of blades 14, and are so deep that blades 14 do not touch their bottoms of grooves 11a. Each charcoal filter rods Fc transferred from drum 5c to drum 8c, after each charcoal filter rods Fc passed at transfer point P1 (FIG. 1), is cut by blades 14 into six pieces of the same length as grooved drum 8c and shafts 13 rotate. Hence, six filter tips Fc1 to Fc6 are provided at point P2 downstream of lower shaft 13.

As is illustrated in FIG. 1, filter-transporting drum 15c is provided on the right side of grooved drum 8c, in rolling contact with drum 8c. Drum 15c is similar to drum 8c in structure. More specifically, it has twelve grooves 16 cut in its periphery and extending parallel to its axis. These parallel grooves are arranged at regular intervals in the circumferential direction of drum 15c. Drum 15c has the same diameter as drum 8c. Therefore, the interval between any two adjacent grooves 16 is identical to the interval between any two adjacent grooves 9 of grooved drum 8c. For the same reason, drum 15c rotates at the same circumferential speed as drum 8c, but in the opposite direction, when drum 8c rotates. Drum 15c is so arranged that its grooves 16 come into alignment with grooves 9 of drum 8c at the point where drums 8c and 15c contact. Hence, filter rod Fc is transferred from groove 9 of drum 8c into groove 16 of drum 15c when these grooves are aligned. Six filter tips Fc1 to Fc6 held within one of grooves 16, is farther transported as filter-transporting drum 15c rotates counterclockwise, while being guided by arcuate guide 17.

Figure 3:
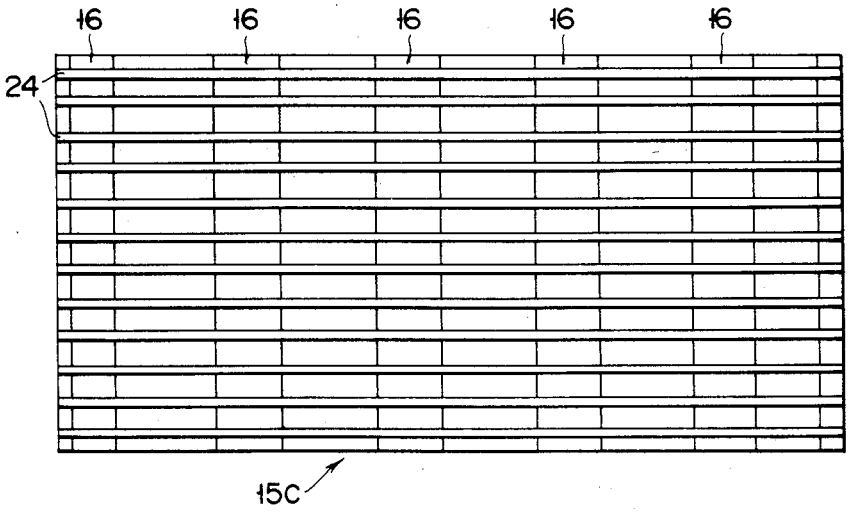
FIG. 3 is a side view showing the periphery of the filter-transporting drum used in the apparatus shown FIG. 1.

As is shown in FIG. 1, arcuate guide 17, which is similar to guide 10, surrounds part of the periphery of filter-transporting drum 15c. As is shown in FIG. 3, twelve annular grooves 24 are cut in the periphery of drum 15c and extend in the circumferential direction thereof. Arcuate guide 17 has six fingers protruding from its one end near to grooved drum 8c. As has been described, arcuate guide 10 has twelve fingers protruding from its lower end. These fingers of guide 10 form six pairs, each for guiding one charcoal filter tip. These fingers of guide 10 protrude into annular grooves 24 of drum 15c, but do not contact the bottom or side walls of these annular grooves 24. The six fingers extending from one end of guide 17 protrude into annular grooves 11 of drum 8c, but do not contact the bottom or side walls of these annular grooves 11. Hence, as is shown in FIG. 1, the fingers of guide 10 and those of guide 17 overlap at the contacting point of drums 8c and 15c. This ensures the smooth transfer of charcoal filter tips Fc1 to Fc6 from drum 8c to drum 15c.

In the embodiment of FIGS. 1, grooved drum 8c has twelve annular grooves 9 as has been described. Nonetheless, two annular grooves are sufficient. This is because groove 6 of drum 5c comes into alignment with every sixth groove of drum 8c, i.e., only the sixth and twelfth grooves, in order to transfer charcoal filter rods Fc.

Figure 4:
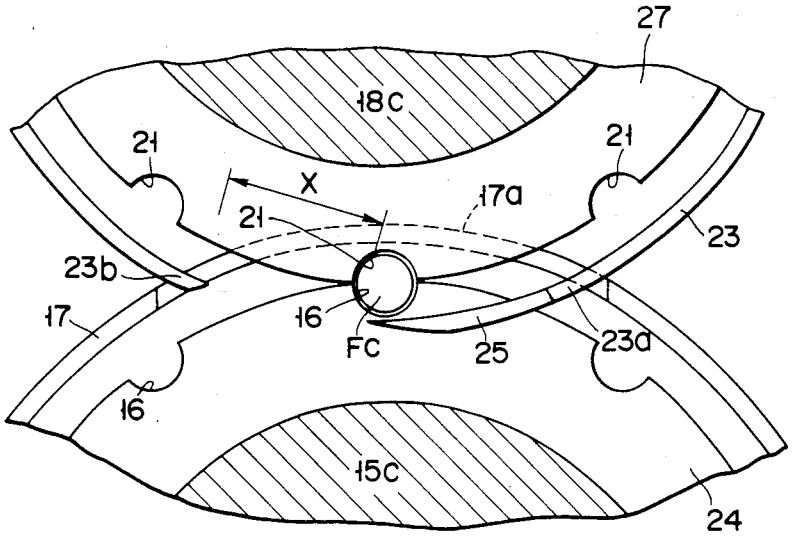
FIG. 4 is a magnified view showing the contacting portions of the filter-transporting drum and the filter-bypassing drum used in the apparatus of FIG. 1.

Three filter-bypassing drums 18c, 19c and 20c, which form one set, are provided on the right side of filter-transporting drum 15c. Drums 18c and 19c extend through two openings cut in arcuate guide 17 and are in rolling contact with drum 15c. More precisely, as is shown in FIG. 4, the peripheral portion of drum 18c extends through opening 17a cut in guide 17 and contacts the periphery of filter-transporting drum 15c. Needless to say, the peripheral portion of drum 19c extends through opening 17a (not shown) cut in guide 17 and contacts the periphery of filter-transporting drum 15c. As drum 15c rotates clockwise, drums 18c and 19c are rotated counterclockwise at the same circumferential speed as drum 15c. Drum 18c has eight grooves 21 cut in its periphery and extending parallel to its axis. Drum 19c has seven grooves 22 cut in its periphery and extending parallel to its axis. Grooves 21 and 22 are spaced around the circumferences of drums 18c and 19c at the same intervals as grooves 16 of drum 15c. Drums 18c and 19c are so positioned with respect to drum 15c that grooves 21 and 22 come into alignment with grooves 16 of drum 15c as drums 18c and 19c rotate.

When any groove 21 of filter-bypassing drum 18c comes into alignment with one of grooves 16 of drum 15c, only four filter tips, i.e., tips Fc1, Fc2, Fc5 and Fc6 are moved from groove 16 into groove 21, whereas the two remaining filter tips, i.e., tips Fc3 and Fc4, stays in groove 16. When any groove 22 of filter-bypassing drum 19c comes into alignment with that groove of drum 15c which holding tips Fc3 and Fc4, only tip Fc3 is moved from groove 16 into groove 22. Filter tips Fc5 and Fc6 are fed back into groove 16 when drum 18c rotates 360°, thus bringing groove 21 again into alignment with groove 16. Filter tip Fc3 is fed back into groove 16 when drum 19c rotates 360° , thus bringing groove 22 again into alignment with groove 16.

Figure 5:
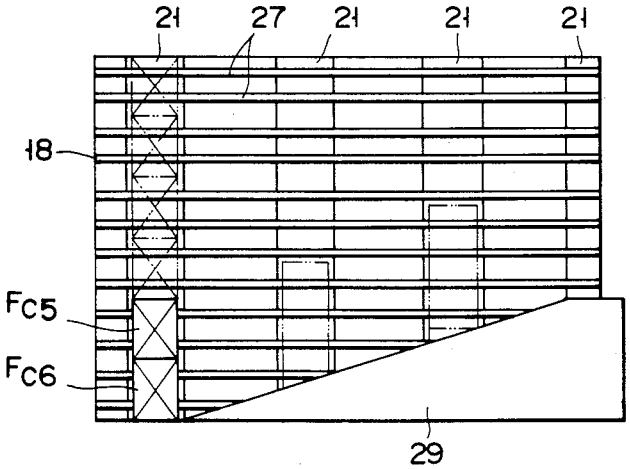
FIG. 5 is is a view showing the periphery of the filter-bypassing drum shown in FIG. 4.

The functions of filter-bypassing drums 18c and 19c will be explained in greater detail, with reference to FIG. 4. FIG. 4 shows the positional relation between filter-transporting drum 15c and filter-bypassing drum 18c. Arcuate guide 23 is provided around drum 18c, except for the portion extending through opening 17a cut in guide 17 provided for drum 15c. Eight fingers 25 extend from right end 23a of guide 23 to the point where drums 15c and 18c contact. Fingers 25 protrude into those of annular grooves 24 which are provided for filter tips Fc1, Fc2, Fc5 and Fc6, but not contacting the bottoms of these annular grooves 24. Annular grooves 24 are deeper than grooves 16. Therefore, as drums 15c and 18c rotate, fingers 25 can scoop tips Fc1, Fc2, Fc5 and Fc6 from the point where drums 15c and 18c contact. Guide 23 holds tips Fc1, Fc2, Fc5 and Fc6 within groove 21. These filter tips are, therefore, transported by drum 18c. On the other hand, filter tips Fc3 and Fc4 remain in groove 16, as shown in FIG. 5, and are farther transported as filter-transporting drum 15c rotates.

A suction unit, which is designed to suck air into filter-bypassing drum 18c, can be provided in the region identified by mark X in FIG. 4. If this is the case, filter tips Fc1, Fc2, Fc5 and Fc6 can be more readily transferred from drum 15c to drum 18c.

As is shown in FIG. 1, filter-bypassing drum 20c is in rolling contact with filter-bypassing drum 18c. More specifically, the peripheral portion of drum 20c extends through an opening (not shown) cut in guide 23 and contacts the periphery of drum 18c. Like drum 18c, drum 20c has eight grooves 26 cut in its periphery and extending parallel to its axis. Grooves 26 are spaced around the circumferences of drum 20c at the same intervals as grooves 21 of drum 18c. Drum 20c is so positioned with respect to drum 18c that grooves 26 come into alignment with grooves 21 of drum 18c as drums 18c and 20c rotate.

When any groove 26 of filter-bypassing drum 20c comes into alignment with one of grooves 21 of drum 18c, only two filter tips, i.e., tips Fc1 and Fc2 are transferred from drum 18c to drum 20c, and the two remaining filter tips, i.e., tips Fc5 and Fc6, stay in groove 16. Filter tips Fc1 and Fc2 are fed back into groove 21 when drum 20c rotates 360° , thus bringing groove 26 again into alignment with groove 21.

The function of filter-bypassing drum 20c will be explained in greater detail, with reference to FIG. 5. FIG. 5 shows filter-bypassing drum 18c. As is shown in this figure, drum 18c has twelve parallel annular grooves 27 cut in its periphery and extending in its circumferential direction. These annular grooves 27 are deeper than grooves 21. As is shown in FIG. 1, arcuate guide 28 is provided around drum 20c, except for the portion extending through the opening (not shown) cut in guide 23 provided for drum 18c. Four fingers (not shown) extend from the upper end of guide 28 to the point where drums 18c and 20c contact. These fingers protrude into those of annular grooves 27 which are provided for filter tips Fc1 and Fc2, but not contacting the bottoms of these annular grooves 27. Since annular grooves 27 are deeper than grooves 21, fingers can scoop tips Fc1 and Fc2 from the point where drums 18c and 20c contact, as drums 18c and 28c rotate. Guide 28 holds tips Fc1 and Fc2 within groove 26. Filter tips Fc1 and Fc2 are, therefore, transported by drum 20c.

Filter tips Fc5 and Fc6 remain in groove 21, and are farther transported as filter-transporting drum 18c rotates. As is shown in FIG. 5, tapered guide rail 29 is secured to the inner surface of guide 23. As drum 18c rotates, filter tips Fc5 and Fc6 slide on this rail 29, and are gradually moved in the lengthwise direction of groove 21. When groove 21, in which tips Fc5 and Fc6 are held, comes into alignment with groove 16 of drum 15c, tips Fc5 and Fc6 have moved for the distance equal to the total length of two charcoal filter tips. Thus, tips Fc5 and Fc6 are fed back into groove 16 of drum 15c, these tips Fc5 and Fc6 assume positions once taken by tips Fc3 and Fc4 which have been transported forward by the rotation of drum 15c.

In the meantime, filter tips Fc1 and Fc2 in groove 26 of filter-bypassing drum 20c are farther transported as filter-transporting drum 20c rotates. A tapered guide rail (not shown), which is similar to rail 29, is secured to the inner surface of arcuate guide 28. As drum 20c rotates, filter tips Fc1 and Fc2 slide on this rail, and are gradually moved in the lengthwise direction of groove 26. When groove 26, in which tips Fc1 and Fc2 are held, comes into alignment with groove 21 of drum 18c, tips Fc1 and Fc2 have moved for the distance equal to the total length of two charcoal filter tips. Thus, tips Fc1 and Fc2 are fed back into groove 21 of drum 18c, these tips Fc1 and Fc2 assume the positions once taken by tips Fc5 and Fc6 which have been transported forward by the rotation of drum 18c. To ensure the transfer of tips Fc1 and Fc2 from drum 20c to drum 18c, fingers extend from the other end of arcuate guide 28 into annular grooves 27 of drum 18c.

Filter tips Fc1 and Fc2, fed back into groove 21 of drum 18c from drum 20c, are further fed back into groove 16 of drum 15c from drum 18c in the same way as filter tips Fc5 and Fc6, as drum 18c rotates. In groove 16, tips Fc1 and Fc2 are moved to the positions once taken by tips Fc3 and Fc4, also in the same manner as tips Fc5 and Fc6 have been moved.

Meanwhile, filter tips Fc3 and Fc4 are farther transported as drum 15c rotate, irrespective of filter-bypassing drum 18c. When tips Fc3 and Fc4 reach filter-bypassing drum 19c, only tip Fc 3 is transferred from groove 16 into groove 22 of drum 19c. More specifically, arcuate guide 30 is provided around drum 19c for guiding tip Fc3 from groove 16 of drum 15c to groove 22 of drum 19c. As can be understood from FIG. 1, guide 30 is similar in structure to arcuate guides 23 and 28 provided for drums 18c and 20c, respectively. Although not shown, a tapered guide rail is secured to the inner surface of guide 30. This guide rail is designed to move filter tip Fc3 along groove 22 of drum 19c for the distance equal to the length of one filter tip, as drum 19c rotates. Therefore, when tip Fc3 is fed back from groove 22 into groove 16 of filter-transporting drum 15c, it assumes the position once taken by filter tip Fc4 which has been transported forward by the rotation of drum 15c.

Filter tips Fc5 and Fc6, which have been moved from groove 16 of drum 15c to groove 21 of drum 18c and then fed back to groove 16 of drum 15c, and filter tips Fc1 and Fc2, which have been moved from groove 16 of drum 15c to groove 22 of drum 20c through groove 21 of drum 18c and then fed back to groove 16 of drum 15c, are farther transported as drum 15c continues to rotate. Then, one of the first pair, i.e., tip Fc5, and one of the second pair, i.e., Fc1, are transferred from drum 15c into groove 26 of filter-bypassing drum 19c. These filter tips Fc5 and Fc1 are transferred back to groove 16 of drum 15c again.

Figure 6:
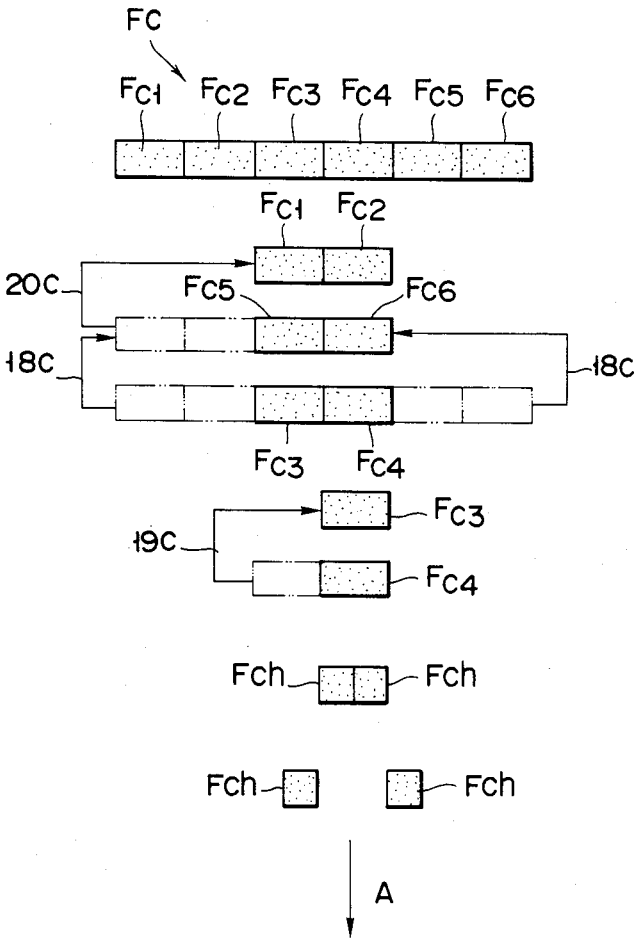
FIG. 6 is a diagram explaining the order in which the filter tips cut from a filter rod are transported.

FIG. 6 illustrates how six tips Fc1 to Fc6 cut from a single charcoal filter rod Fc are bypassed by filter-bypassing drums 18c, 19c and 20c, except for tip Fc4, and are finally fed back to filter-transporting drum 15c. In FIG. 6, arrow A indicates the direction in which tips Fc1 to Fc6 are transferred from one drum to another, that is, the directions in which drums 18c, 19c and 20c rotate; arrows 18c, 19c and 20c represent the functions of drums 18c, 19c and 20c, respectively. As is clearly shown by arrows 18c, 19c and 20c, filter-bypassing drums 18c, 19c and 20c operate to move all filter tips, but tip Fc4, back to filter-transporting drum 15c, with various time-lags corresponding to different numbers of grooves of drum 15c. In other words, each groove 21 of drum 18c and the corresponding groove 16 of drum 15c define a first by-pass; each groove 22 of drum 19c and the corresponding groove 16 of drum 15c define a second by-pass; and the corresponding grooves 21 and 26 of drums 18c and 20c and the corresponding groove 16 of drum 15c define a third by-pass. Apparently, these three by-passes have different lengths.

Figure 7:
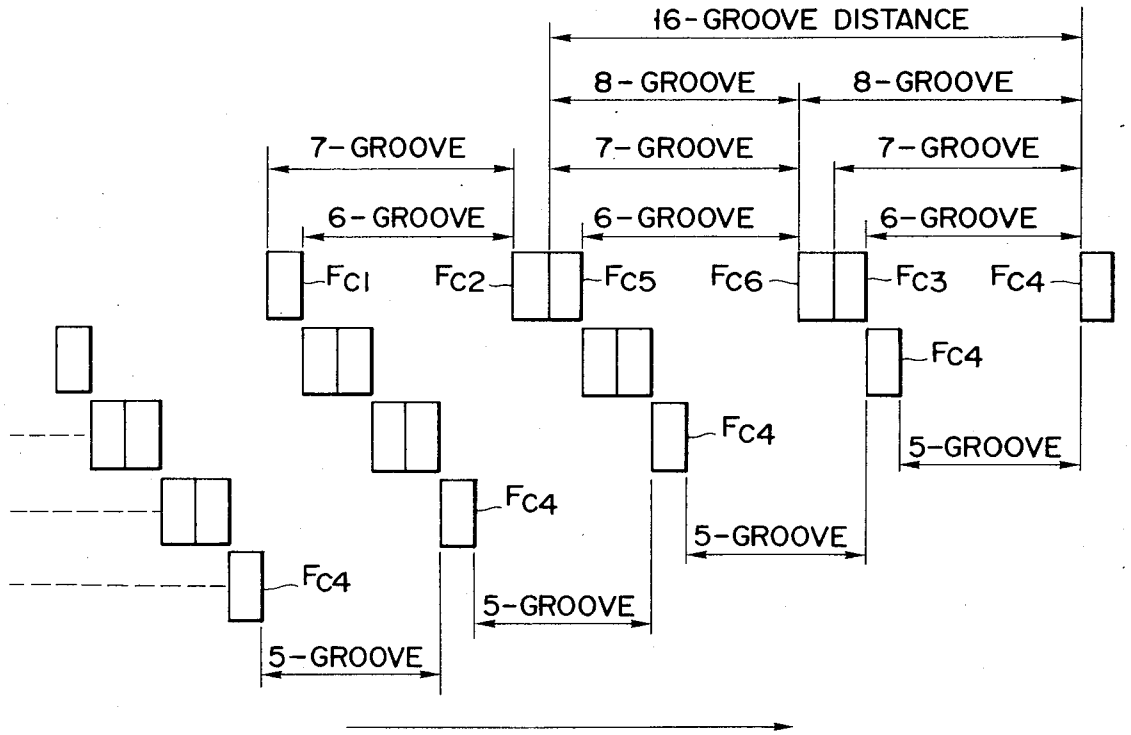
FIG. 7 is a diagram illustrating how the filter tips are supplied one after another.

FIG. 7 shows more clearly how how six tips Fc1 to Fc6 cut from a single charcoal filter rod Fc are bypassed by drums 18c, 19c and 20c and are finally fed back to filter-transporting drum 15c, with various time-lags. In FIG. 7, the six filter tips are shown as if they were positioned in the same, narrow, straight transport path defined by the grooves of drums 15c, 18c, 19c and 20c. The arrows in this figure represent the directions in which tips Fc1 to Fc6 are transported as drums 15c, 18c, 19c and 20c rotate.

As can be clearly understood from the above, of the six filter tips provided from the first charcoal filter rod Fc supplied from hopper 3c, tip Fc4 is transported most forwardly. Filter tip Fc3 is placed in the seventh groove upstream from the groove receiving tip Fc4 since filter-bypassing drum 19c has seven grooves 22. In other words, tip Fc3 is transported with a delay equivalent to seven-groove distance, with respect to filter tip Fc4. Namely, six grooves exist between filter tips Fc4 and Fc3. Filter tip Fc6, which is bypassed by drum 18c, jointly with filter tip Fc5, is transported with a delay corresponding to eight-groove distance, with respect to filter tip Fc4, since filter-bypassing drum 18c has eight grooves 21. Hence, tips Fc6 is delayed by one-groove distance from tip Fc3, as is shown in FIG. 7. Filter tip Fc5, which is also bypassed by drum 18c, is delayed by seven-groove distance from tip Fc6, in exactly the same way as tip Fc3 is delayed with respect to tip Fc4. Filter tips Fc1 and Fc2 are bypassed not only by drum 18c, but also by drum 20c. Since drum 20c has eight grooves 26, these filter tips Fc1 and Fc2 are delayed by eight-groove distance with respect to tips Fc5 and Fc6. Further, tip Fc 1, which is bypassed by drum 19c having seven grooves 22, is delayed by seven-groove distance from tip Fc2. Consequently, as is shown in FIG. 7, filter tip Fc2 is delayed by one-groove distance from filter tip Fc5, and filter tip Fc2 is delayed by 16-groove distance from the most forward tip Fc4. As a result, the six filter tips, obtained by cutting a single charcoal filter rod Fc, are supplied forward along the same transport path, set part from one another for the prescribed distances, as is illustrated in FIG. 7.

It has been explained how the six filter tips of the first set, provided by cutting first charcoal filter rod Fc, are transported after they have been supplied into one of the grooves 16 of filter-transporting drum 15c. The other sets of filter tips, obtained by cutting other filter rods Fc, are sequentially supplied from grooved drum 8c into every sixth groove 16 of drum 15c, as has been described above. The six filter tips of each of these sets are transported and bypassed by drums 15c, 18c, 19c and 20c in the same manner as the tips of the first set. The six tips of the second set are fed into the sixth groove of drum 15c, whereas the six tips of the first set were fed into the first groove of drum 15c. Since filter tip Fc4 of the second set is not bypassed by filter-bypassing drum 18c, 19c or 20c, it is delayed by the distance defined by five grooves 16 of drum 15c, with respect to filter tip Fc4 of the first set. Filter tip Fc4 is thus eventually set apart by the five-groove distance from tip Fc4 of the first set on the transport path located downstream of all filter-bypassing drums 18c, 19c and 20c. The same holds true of tip Fc4 of any other set with respect to tip Fc4 of the immediate preceding set, as is evident from FIG. 7.

As is clearly shown also in FIG. 7, filter tip Fc4 of the fourth set, i.e., one of the six tips obtained from the fourth charcoal filter rod Fc, is delayed by the one-groove distance from the most delayed tip Fc1 of the first set.

Further, as is evident from FIG. 7, too, all filter tips, that are delayed with respect to the most forward tip Fc4 of the fourth set, are fed from filter-bypassing drum 19c back to filter-transporting drum 15c and then distributed to grooves 16 of drum 15c. In other words, all grooves 16 following groove 16 holding tip Fc4 of the fourth set are filled each with one filter tip. Hence, after groove 16 containing tip Fc4 of the fourth set has passed by filter-bypassing drum 19c, all filter tips located downstream of drum 19c are transported one after another at equal, one-groove intervals.

As is shown in FIG. 1, filter-cutting/separating drum 31c is provided below filter-transporting drum 15c. This drum 31c is in rolling contact with that portion of drum 15c which is provided downstream of filter-bypassing drum 19c, and can rotate at the same circumferential speed as drum 15c. Twelve grooves 32 are cut in the periphery of drum 31c, parallel with the axis of drum 31c, and equally spaced from one another around the circumference of drum 31c, at the same intervals as grooves 16 of drum 15c. Hence, as drum 15c rotates, drum 31c rotates in the opposite direction such that grooves 32 sequentially come into alignment with grooves 16 of filter-transporting drum 15c. Arcuate guide 33 surrounds the greater part of the periphery of filter-cutting/separating drum 31c. Guide 33 serves to ensure the transfer of filter tips Fcn (n=1 to 6) between drums 15c and 31c and to guide tips Fcn while they are being transported. Guide 33 has the same structure as guide 6 provided for grooved drum 8c, which has been described in detail. Guided by arcuate guide 33, filter tips Fcn are transferred from groove 16 of drum 15c into grooves 32 of filter-cutting/separating drum 31c. As has been described above, after groove 16 containing tip Fc4 of the fourth set has passed by filter-bypassing drum 19c, all grooves 16 following groove 16 holding tip Fc4 of the fourth set are filled each with one filter tip. Hence, tips Fcn are transferred, one after another at equal, one-groove intervals, from grooves 16 of drum 15c into grooves 33 of filter-cutting/separating drum 31c.

Moreover, filter-juxtaposing drum 34 is provided below filter-cutting/separating drum 31c, in rolling contact therewith. Hence, drum 34 can rotate at the same circumferential speed as drum 31c, but in the opposite direction. Grooves 35 are cut in the periphery of drum 34, parallel with the axis of drum 31c, and equally spaced from one another around the circumference of drum 31c, at the same intervals as grooves 32 of drum 31c. Hence, as drum 31c rotates, filter-juxtaposing drum 34 rotates such that grooves 35 sequentially come into alignment with grooves 32 of filter-cutting/separating drum 31c. First filter-juxtaposing guide 36 is provided, surrounding a part of the periphery of drum 34. First filter-juxtaposing guide 36 has the same structure as guide 33 provided for drum 31c and performs the same function as guide 33.

Figure 8:
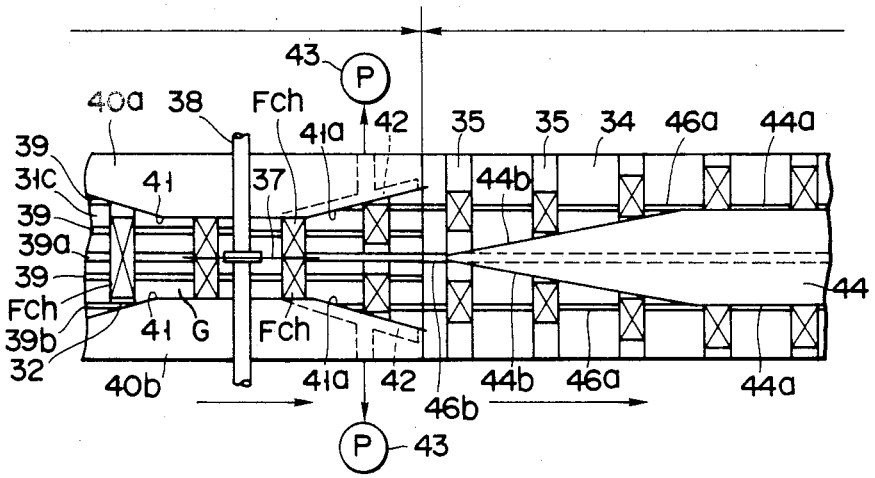
FIG. 8 shows those portions of the filter-cutting-/separating drum and filter-juxtaposing drum, both shown in FIG. 1, which are in rolling-contact.
Figure 9:
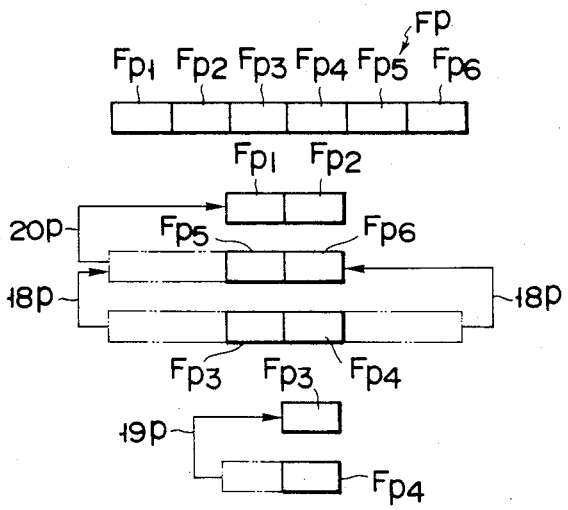
FIG. 9 is a diagram explaining how the filter tips are supplied one after another.

As is shown in FIG. 8, annular groove 39a is cut in the periphery of filter-cutting/separating drum 31c. Circular blade 37 is mounted on shaft 38. Its peripheral edge extends into annular groove 39a through a slit (not shown) cut in arcuate guide 33 provided for drum 31c. Hence, blade 37 can cut every filter tip Fcn, placed in groove 32 of drum 31c, into two pieces of the same length. Other annular grooves 39, which are similar to annular grooves 11 of grooved drum 8c, are cut in the periphery of filter-cutting/separating drum 31c. The fingers extending from the lower end of arcuate guide 17 provided for drum 15c are inserted in these annular grooves 39, respectively, but touching neither the bottoms nor side walls thereof.

As is shown in FIG. 8, a pair of guide rails 40a and 40b are secured to the inner surface of guide 33 provided for filter-cutting/separating drum 31c. Both rails 40a and 40b extend along the circumference of drum 31c. They are spaced from each other, thus forming narrow gap G extending along the circumference of drum 31c. Those end portions of rails 40a and 40b, which are located upstream with respect to the filter-transport path indicated by an arrow, are inclined such that gap G gradually decreases in the direction of the arrow. Those end portions of rails 40a and 40b, which are located downstream with respect to the filter-transport path, are inclined such that gap G gradually increases in the direction of the arrow. The middle portions of rails 40a and 40b are straight and set apart for the distance substantially equal to the length of filter tips Fcn. As is shown also in FIG. 8, the circular blade 37 is located between these straight, middle portions of guide rails 40a and 40b.

Due to their specific shapes described in the preceding paragraph, guide rails 40a and 40b can readily guide every filter tip Fcn into narrow gap G between their straight, middle portions. Since this narrow gap is substantially equal to the length of tip Fcn, any filter tip Fcn guided into this gap cannot move in the widthwise direction of filter-cutting/separating drum 31c, and can therefore be cut by blade 37 into two tip halves Fch of the same length, as is clearly shown in FIG. 6. At point P5 shown in FIG. 1, each tip Fcn is intact. At point P6 shown also in FIG. 1, tip Fcn is cut into tip haves Fch. As a result, pairs of tip halves Fch, not tips Fcn, are moved into grooves 35 of filter-juxtaposing drum 34.

As is shown in FIG. 8, recesses 42 are cut in the opposing sides of the inclined, downstream end portions of guide rails 40a and 40b. These recesses 42 are covered with nets (not shown) and connected to vacuum pump 43, thereby providing two suction areas 41a on the opposing sides of the downstream end portions of rails 40a and 40b. When pump 42 is driven, tip halves Fch are attracted to suction areas 41a, respectively, and separated from each other. At the downstream ends of guide rails 40a and 40b, tip halves Fch are spaced in groove 32, with a specified gap between them. As is illustrated in FIG. 8, circular blade 37 overlaps suction areas 41a. This makes it possible for tip halves Fch to move away from each other as soon as they are cut from filter tip Fcn.

Referring to FIG. 8, filter-separating guide 44 is fixed to the inner periphery of first filter-juxtaposing guide 36 of filter-juxtaposing drum 34. This guide 44 extends round the circumference of filter-juxtaposing drum 34 for guiding tip halves Fch. It is aligned with drum 34 along the filter-transport path. Both sides of guide 44 function as guide surfaces 44a. The upstream end portion of guide 44 has both sides 44b tapered. Two tip halves Fch, obtained by cutting one filter tip Fcn and transferred from from drum 31c into groove 35 of filter-juxtaposing drum 34 are separated from each other by guide 44 as drum 34 rotates. More precisely, as drum 34 rotates, tip haves Fch are guided first by tapered sides 44b of guide 44 and then by guide surfaces 44a. Tip halves Fch are eventually spaced from each other for the distance equal to the width of filter-separating guide 44. This distance is slightly longer than each filter tip Fcn, for the reason which will later be described. Two tip haves Fch, provided by cutting a filter tip Fcn, can readily be spaced for this specific distance by filter-separating guide 44 since the tip halves remain separated when they are transferred from drum 31c into groove 35 of filter-juxtaposing drum 34. Two parallel annular grooves 46a and 46b are cut in the periphery of drum 34. The fingers extending from the lower end of arcuate guide 33, which is provided for drum 31*c*, are inserted into these groove 46*a* and 46*b*, contacting neither the bottoms nor the side walls thereof.

Now, second filter-supplying mechanism 2*p* will be described. As is shown in FIG. 1, this mechanism 2*p* is provided to the right of first filter-supplying mechanism 2*c* and above filter-juxtaposing drum 34. Mechanism 2*p* processes plain filter rods Fp, whereas mechanism 2*c* processes charcoal filter rods Fc. Mechanism 2*p* is structually identical to first filter-supplying mechanism 2*c*, except for some points. Therefore, the same components are designated by the same numerals as denoting the corresponding components of mechanism 2*c*, and will not described in detail. In FIG. 1, each number in parentheses represents the number of grooves which a drum has.

Three major differences exist between first filter-supplying mechanism 2*c* and second filter-supplying mechanism 2*p*. First, as is shown in FIG. 1, the filter-transporting drum 15*p* of mechanism 2*p* has more grooves 16 than the filter-transporting drum 15*c* of mechanism 2*c*. Secondly, as is evident also from FIG. 1, no component equivalent to filter-cutting/separating drum 31*c* provided. Thirdly, drum 15*p* is located downstream of drum 31*c* with respect to the filter-transport path, and is in rolling contact with filter-juxtaposing drum 34 at the point where the end of first filter-juxtaposing guide 36 is located.

Grooved drum 8*p* cooperates with circular blades 14 to cut each plain filter rod Fp supplied from hopper 3*p* into six filter tips Fp1 to Fp6, in the same way as grooved drum 8*c* of first filter-supplying mechanism 2*c*. As drum 8*p* rotates clockwise, filter tips Fp1 to Fp6 are simultaneously transferred from groove 9 of drum 8*c* into groove 16 of drum 15*p*. All of these tips Fp1 to Fp6, but one, are then bypassed by filter-bypassing drums 18*p*, 19*p* and 20*p* in the same way as tips Fc1 to Fc6 are bypassed by drums 18*c*, 19*c* and 20*c* of first mechanism 2*c*. Filter tips Fpn, including tips Fp1 to Fp6 and other tips provided by cutting other plain filter rods Fp, are transferred, one after another, from grooves 16 of drum 15*p* into grooves 35 of filter-juxtaposing drum 34. Plain filter rods Fp not necessarily have the same length as charcoal filter rods Fc. Accordingly, filter tips Fpn need not have the same length a filter tips Fcn.

As can be understood from the above, two charcoal tip halves Fch are supplied from first filter-supplying mechanism 2*c* into each groove 35 of filter-juxtaposing drum 34, and one plain filter tip Fpn is supplied into the same groove 35 from second filter-supplying mechanism 2*p*. Plain filter tip Fpn is put in the gap between charcoal tip halves Fch. This gap is slightly longer than filter tip Fpn separated by filter-separating guide 44, as has been stated above and as is shown at point P7 (FIG. 1). Plain filter tip Fpn and tip halves Fch can supplied into the same groove 35 of filter-juxtaposing drum 34, tip Fpn being interposed between tip haves Fch. Plain filter tip Fpn and charcoal tip halves Fch, thus axially aligned, are transferred from drum 34 to wrapping section 100.

As is shown in FIG. 1, second filter-juxtaposing guide 45 is provided downstream of first filter-juxtaposing guide 35 with respect to the filter-transport path, and surrounds a part of the periphery of filter-juxtaposing drum 34, in order to guide tip halves Fch and filter tip Fpn. Two guide rails (not shown) are secured to the inner periphery of second filter-juxtaposing guide 45. This guide rails push tip halves Pch toward plain filter tip Fpn as drum 34 rotates, thus transporting tip halves Fch and filter tip Fpn forward. At last, at point P8 (FIG. 1), tip halves Fch abut against the ends of plain filter tip Fpn, respectively, thus forming a long dual filter tip DF, which will be later cut into two dual tips of the ordinary length.

Wrapping section 100 is of the known type. Its structure will, therefore, be described briefly with reference to FIG. 1. As is shown in this figure, section 100 comprises filter-aligning drum 46, unfinished product-supplying drum 51, roller 53, glue-applying unit 55, and wrapping drum 57. Filter-aligning drum 46 is arranged below filter-juxtaposing drum 34, and put in rolling contact therewith. It has grooves 47 cut in its periphery, extending parallel to its axis, and spaced at equal intervals around the circumference. Drum 46 is so positioned that its grooves 47 sequentially come into alignment with grooves 35 of drum 34 as drums 34 and 46 rotate in the opposite directions. Hence, dual filter DF is transferred from groove 35 of drum 34 into groove 47 of drum 46 when these grooves are aligned. Then, dual filter DF is transported forward as filter-aligning drum 46 rotates.

In the meantime, two cigarettes are supplied into groove 47 of filter-aligning drum 46 from a cigarette-supplying section comprising first cigarette-supplying drum 48 and second cigarette-supplying drum 49. Drum 48 is provided upstream of filter-aligning drum 46 with respect to the cigarette-transport path, and put in rolling contact with filter-aligning drum 46. Drum 49 is in rolling contact with drum 48. Drum 48 has grooves 50 cut in its periphery, extending parallel to its axis, and spaced at equal intervals around the circumference. Drum 49 also has grooves 50 cut in its periphery and extending parallel to its axis. Grooves 50 of drum 49 are spaced around the circumference of drum 49 at the same intervals as grooves 50 of drum 48. Therefore, they sequentially come into alignment with grooves 50 of drum 48 as drum 48 is rotated, and as drum 49 is rotated. Two cigarettes C1 and C2 are supplied into any groove 50 of drum 49. Cigarettes C1 and C2 are transferred from this groove into groove 50 of drum 48 when these grooves come into alignment. Thereafter, cigarettes C1 and C2 are transferred from groove 50 of drum 48 into one of grooves 47 of filter-aligning drum 46. Before these cigarettes C1 and C2 are transferred from drum 48 to drum 46, they have been separated by a gap which is, as is shown at point P9 (FIG. 1), slightly longer than dual filter DF. Hence, when dual filter DF is supplied into groove 47 of filter-aligning drum 46, it is interposed between two cigarettes C1 and C2 placed in the same groove of drum 46. At point P10 (FIG. 1), cigarettes C1 and C2 and dual filter DF, all set in groove 47 in this condition, form a single, rod-shaped unfinished product.

As drum 46 rotates forward, groove 47 holding this unfinished product comes into alignment with one of grooves 52 of unfinished product-supplying drum 51, whereby the unfinished product is transferred from groove 47 into grooves 52. Roller 53 is provided below drum 51 and is put in rolling contact therewith. Roller 53 is a suction type one, and feeds a strip 54 of tip paper from a roll (not shown) as it rotates. Glue-applying unit 55 is provided between the tip-paper roll and roller 53. Unit 55 is designed to apply glue onto one side of strip 54. Rotary cutter 56 is provided in rolling contact with roller 53 for cutting strip 54 into pieces 54*a* having a prescribed length. As is shown in FIG. 10, the glue-applied side of a piece 54*a* is adhered to the unfinished product when the unfinished product, set in groove 52 of drum 51, reaches the contacting point of drum 51 and roller 53.

Thereafter, the unfinished product, with piece 54 of tip paper attached to it, is supplied forward as drum 51 rotates. As is shown in FIG. 1, unfinished product-supplying drum 51 is located below and close to wrapping drum 57. Wrapping drum 57 has claws protruding from its periphery. These claws are equidistantly spaced from one another around the circumference of wrapping drum 57. Any two adjacent claws define a space 58 for accommodating an unfinished product. Space 58 is large enough to allow the unfinished product to roll freely. Therefore, when the unfinished produce, with piece 54*a* of tip paper adhered to it, reaches drum 57, it is transferred from groove 52 into space 58 defined by two adjacent claws of drum 57. Once accommodated within space 58, the unfinished product rolls, assisted by rolling hand 59 provided in the narrow gap between drum 51 and wrapping drum 57. As the unfinished product rolls within space 58, piece 54*a* of tip paper is wrapped around the unfinished product, thereby forming a filter cigarette which is twice as long as an ordinary one.

Figure 10:
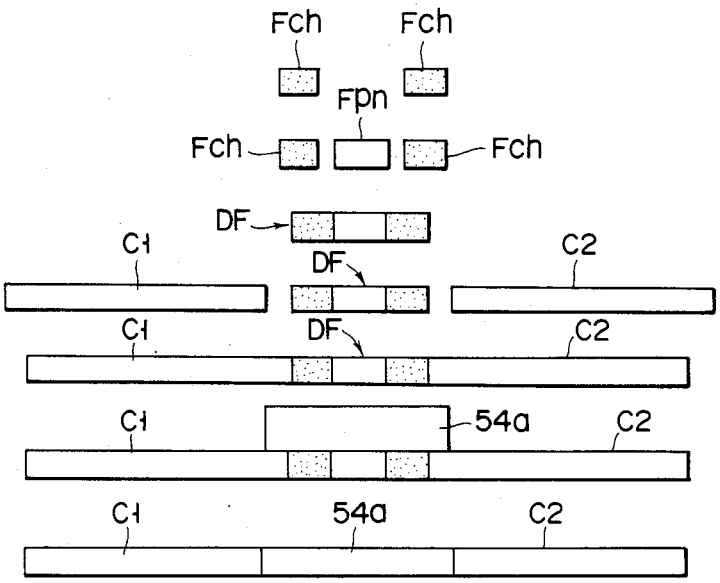
FIG. 10 is a diagram explaining how a dual filter tip is axially aligned with two cigarettes and connected thereto.

FIG. 10 shows how tip halves Fch, filter tip Fpn and cigarettes C1 and C2 are transported from filter-juxtaposing drum 34 to wrapping drum 57, and how they are combined into one long filter cigarette in the sequence of operations described above.

The long filter cigarette, thus produced is transported forward as wrapping drum 57 rotates, and the glue applied on piece 54*a* of tip paper gradually dries in the process, thus making the long cigarette more intact. The long filter cigarette is removed from wrapping drum 57. Thereafter it is cut at the middle of dual filter DF, into two filter cigarettes of the desired length.

It should be noted that each drum of wrapping section 100 is provided with an arcuate guide surrounding part of the periphery of the drum in order to guide the unfinished product. The arcuate guide is similar to those used in first and second filter-supplying mechanisms 2*c* and 2*p*. Therefore, it has not been described in conjunction with the explanation of wrapping section 100.

In the first embodiment of FIG. 1, all grooved drums, used in first and second filter-supplying mechanisms in order to transport the filter tips to wrapping section 100, are rotated at the same circumferential speed. For this reason, these grooved drums can be reliably driven by a drive mechanism of a relatively simple structure.

Since the first embodiment has two filter-supplying mechanisms, i.e., mechanisms 2*c* and 2*p*, for supplying a charcoal filter tip and a plain filter tip to filter-juxtaposing drum 34, drum 34 can provide a dual filter for two cigarettes, which will be supplied to wrapping section 100. Hence, unlike the conventional filter cigarette-manufacturing apparatus, the apparatus shown in FIG. 1 requires no device specially designed to produce dual filters.

The dual filter-producing device, which is used in combination with the conventional filter cigarette-producing apparatus, is designed to alternately arrange charcoal filter tip portions and plain filter tip portions, then to wrap the these tip portions with a piece of paper, thus forming a dual filter rod, and finally to cut this rod into dual filter tips each consisting of one charcoal tip and one plain tip. In the conventional apparatus, each dual filter tip, thus produced by the dual filter-producing device, and cigarettes are wrapped with a piece of tip paper, thereby forming long filter cigarette. Apparently, two wrapping operations are necessary to manufacture one dual-filter cigarette. In the apparatus according to the present invention, only one wrapping operation suffices since one plain filter tip, two charcoal filter tips and two cigarettes are connected at the same time, thus forming a long dual filter cigarette which will be eventually cut into two dual filter cigarettes.

Moreover, since the first embodiment of the invention has two filter-supplying mechanisms, that is, mechanism 2*c* for supplying charcoal filter rods Fc, and mechanism 2*p* for supplying plain filter rods Fp. Hence, about twice as many filter rods can be processed than in the case where only one filter-supplying mechanism is provided. This enables the apparatus to manufacture filter cigarettes with a high productivity, and ultimately helps to reduce the cost of filter cigarettes.

The first embodiment can manufacture not only dual filter cigarettes as has been described above, but also plain filter cigarettes. In order to manufacture plain filter cigarettes, only second filter-supplying mechanism 2*p* is operated.

The present invention is not limited to the first embodiment described above. Various changes and modifications can be made within the spirit and scope of the invention. Some other embodiments of this invention will be described with reference to FIGS. 11 to 19. The the components of the other embodiments, which are the same in function as those used in the first embodiment are designated by the same numerals in FIGS. 11 to 19, and will not be explained in detail in the following description.

Figure 11:
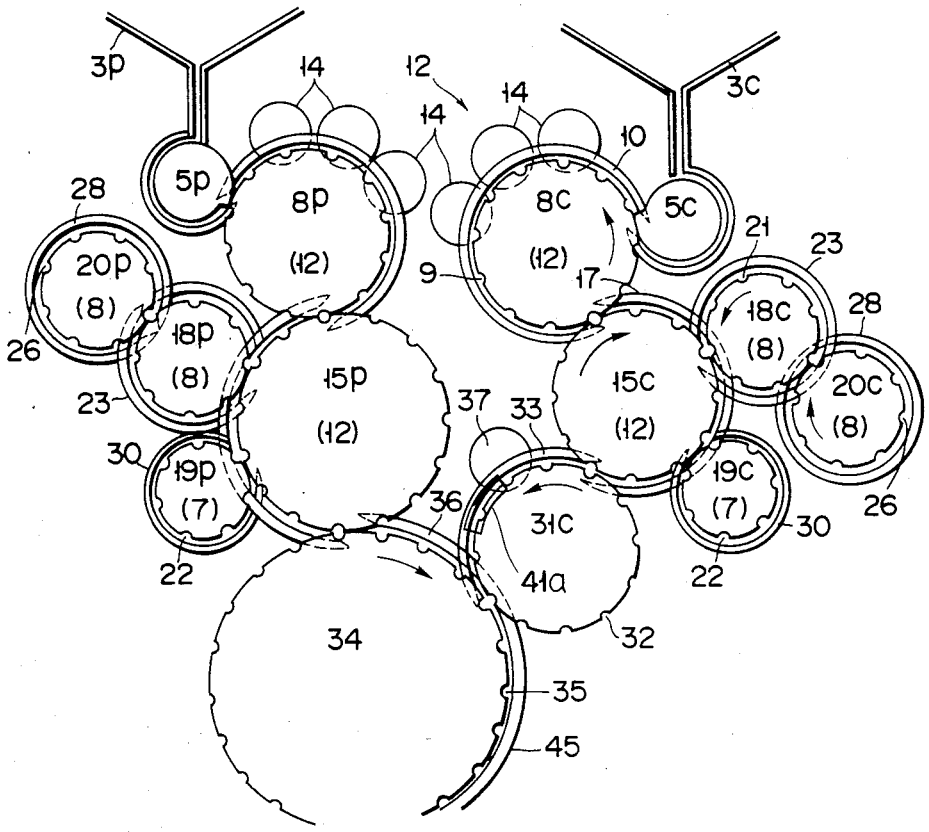
FIG. 11 schematically shows the filter-supplying section of a filter cigarette-manufacturing apparatus according to a second embodiment of this invention.
Figure 12:
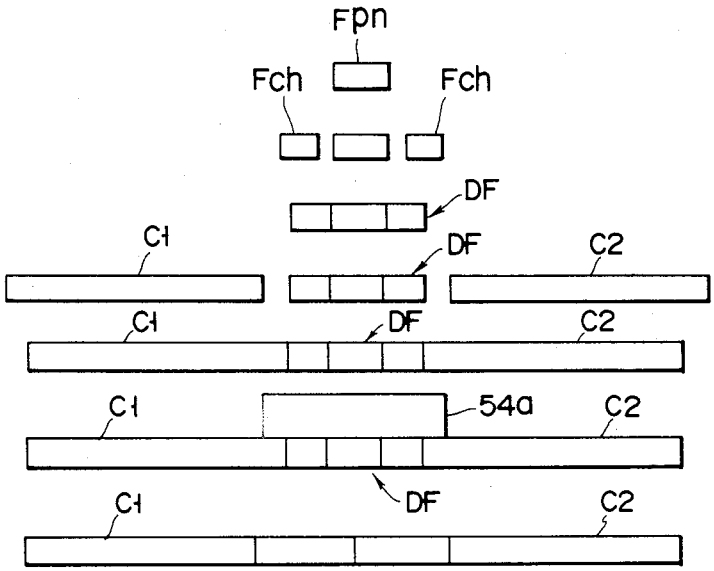
FIG. 12 is a diagram explaining how a dual filter tip is axially aligned with two cigarettes and connected thereto, in the filter-supplying section shown in FIG. 11.

FIGS. 11 and 12 show a second embodiment of this invention. This embodiment is identical to the first embodiment, except that, as can be understood from FIG. 11, the positioning of first and second filter-supplying mechanisms 2*c* and 2*p* is reversed. In the second embodiment, as is clearly shown in FIG. 12, plain filter tip Fpn is supplied from second filter-supplying mechanism 2*p* into one of grooves 35 of filter-juxtaposing drum 34. Then, two charcoal tip halves Fch are supplied into the same groove 35 of drum 34 from first filter-supplying mechanism 2*c*. Filter-separating guide 44 is secured to the inner surface of guide 33 provided for filter-cutting-/separating drum 31*c*, not to the inner surface of first filter-juxtaposing guide 36. Guide 44 is located downstream of guide rails 40*a* and 40*b*, with respect to the filter-transport path. Thus, when tip halves Fch are supplied into groove 35 of drum 34, they spaced from each other for a prescribed distance. Plain filter tip Fpn can, therefore, readily inserted between tip halves Fch.

Figure 13:
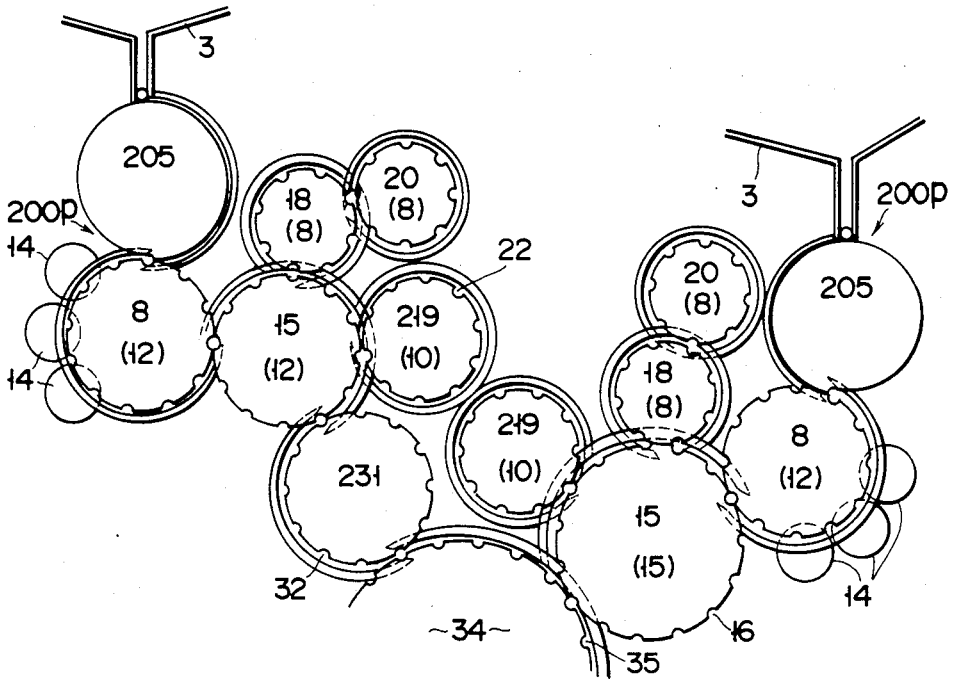
FIG. 13 schematically shows the filter-supplying section of a filter cigarette-manufacturing apparatus according to a third embodiment of this invention.
Figure 14:
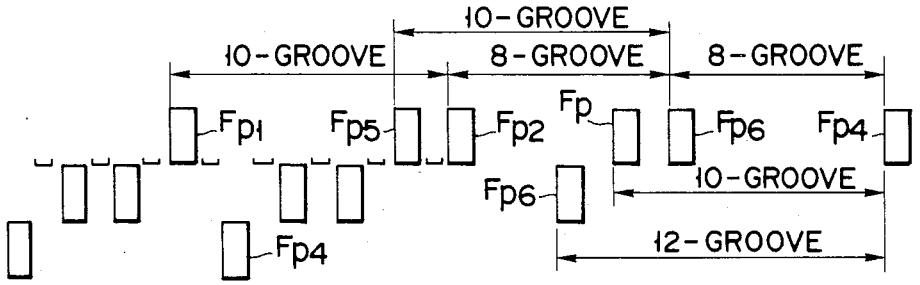
FIG. 14 is a diagram explaining how the filter tips are supplied one after another in the filter-supplying section shown in FIG. 13.
Figure 15:
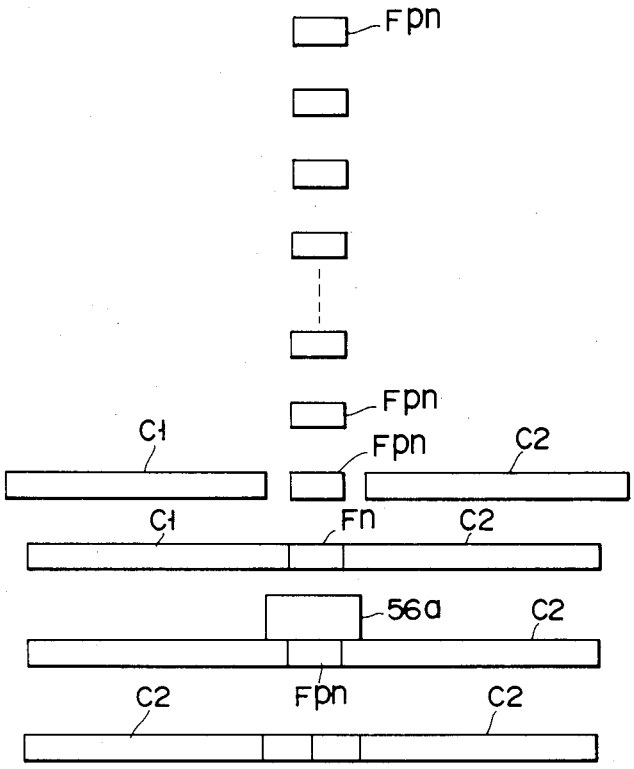
FIG. 15 is a diagram explaining how a dual filter tip is axially aligned with two cigarettes and connected thereto, in the filter-supplying section shown in FIG. 13.

FIGS. 13 to 15 show a third embodiment of this invention. Filter-supplying section 1 of this embodiment comprises two filter-supplying mechanisms 200*p* identical with first and second filter-supplying mechanisms 2*c* and 2*p*. Both mechanisms 200*p* process plain filter rods Fp.

Filter-supplying drums 205 of mechanisms 200*p* have each one groove 6 as drums 5*c* and 5*p* of the first embodiment. They have a diameter twice as great as that of drums 5*c* and 5*p*. In other words, drums 205 have the same diameter as that of grooved drums 8. Hence, the plain filter rods Fp are supplied from either filter supplying drum 205 into every twelfth groove of grooved drum 8 which is in rolling contact with drum 205. Six filter tips Fpn, obtained by cutting each filter rod Fp, are, therefore, supplied from either grooved drum 8 into every twelfth groove of filter-transporting drum 15 which is in rolling contact with this grooved drum 8. Two filter-bypassing drums 219, which correspond to filter-bypassing drums 19*c* and 19*p*, respectively, have each ten grooves 22. Grooved drum 231 is used in place of filter-cutting/separating drum 31*c* included in first filter-supplying mechanism 2*c* of the first embodiment (FIG. 1). As is shown in FIG. 13, no circular blades are provided for this grooved drum 231. Drum 231 is used for no other purposes than to change the direction of transporting filter tips Fpn. In this third embodiment, the filter-juxtaposing guide 36 need not be provided with filter-separating guide 44.

Each of filter-supplying mechanisms 200*p* supplies filter tips Fpn along such a path as is illustrated in FIG. 14. As is shown in this figure, filter tips Fp3, Fp5 and Fp1 are delayed by ten-groove distance with respect to filter tips Fp4, Fp6 and Fp2, respectively. This is because filter-bypassing drum 219 has ten grooves 22. Further, filter tip Fp6 is delayed by eight-groove distance from the most forward filter tip Fp4, and filter tip Fp2 is delayed by 16-groove distance from the most forward filter tip Fp4, as in the first embodiment (FIG. 1). This is because tips Fp4, Fp6 and Fp2 are not bypassed by filter-bypassing drum 219. The six filter tips, provided by cutting the second filter rod Fp, are delayed by 12-groove distance with respect to those tips obtained from the first filter rod Fp, and are then supplied to filter-transporting drum 15*c*. As a result, filter tip Fp4 provided from the second filter rod Fp is delayed by 12-groove distance with respect the most forward tip Fp4 cut from the first filter rod Fp.

As filter rods Fp are supplied from hopper 3 to each filter-supplying mechanism 200*p*, mechanism 200*p* supplies plain filter tips Fpn into every other groove 35 of filter-juxtaposing drum 34. Both filter-supplying mechanisms 200*p* supply tips Fpn to drum 34 in the same manner. Hence, the tips supplied from first filter-supplying mechanism 200*p*, and the tips supplied from the second filter-supplying mechanism 200*p*, are received in the alternate grooves 35 of filter-juxtaposing drum 34. These filter tips Fpn are sequentially supplied from drum 34 into grooves 47 of filter-aligning drum 46 (not shown) of wrapping section 100.

Thereafter, as is shown in FIG. 15, two cigarettes C1 and C2 are positioned on both sides of each filter tip Fpn. Piece 54*a* of tip paper is wrapped around cigarettes C1 and C2 and tip Fpn, thereby forming a filter cigarette twice as long as a filter cigarette of the ordinary length.

Filter-supplying section 1 of the third embodiment, which has two identical filter-supplying mechanisms 200*p*, can supply twice filter tips Fpn to wrapping section 100 at the speed twice higher than the speed at which the filter section of the apparatus, which has only one filter-supplying mechanism, supplies filter tips. This means, that section 1 of the third embodiment can supply twice as many filter tips Fpn to section 100 per unit time, as can the filter-supplying section of the conventional apparatus. Obviously, the third embodiment (FIG. 13) can manufacture filter cigarettes with a high productivity.

Figure 16:
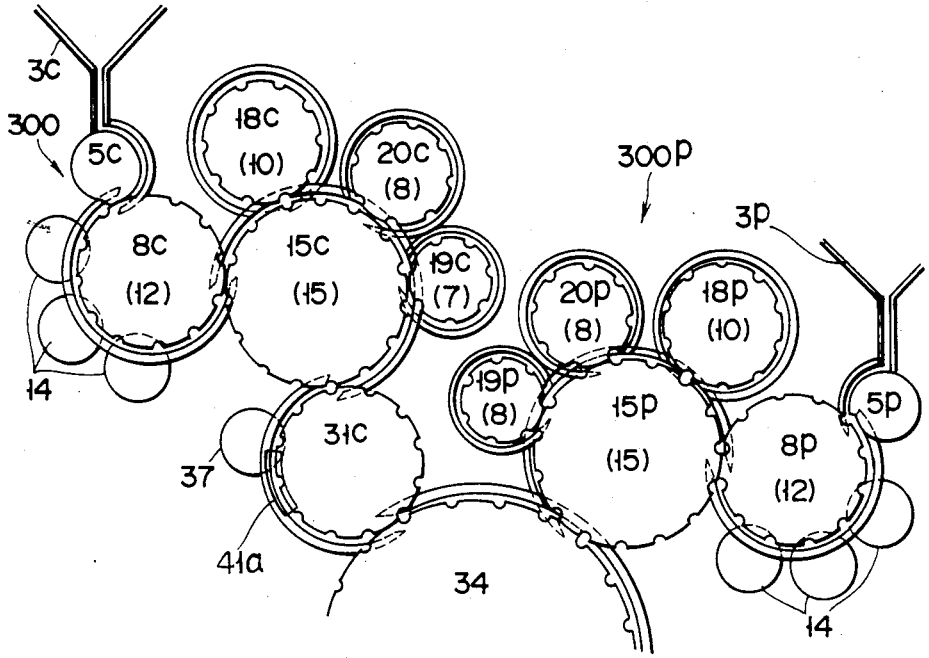
FIG. 16 schematically shows the filter-supplying section of a filter cigarette-manufacturing apparatus according to a fourth embodiment of this invention.
Figure 17:
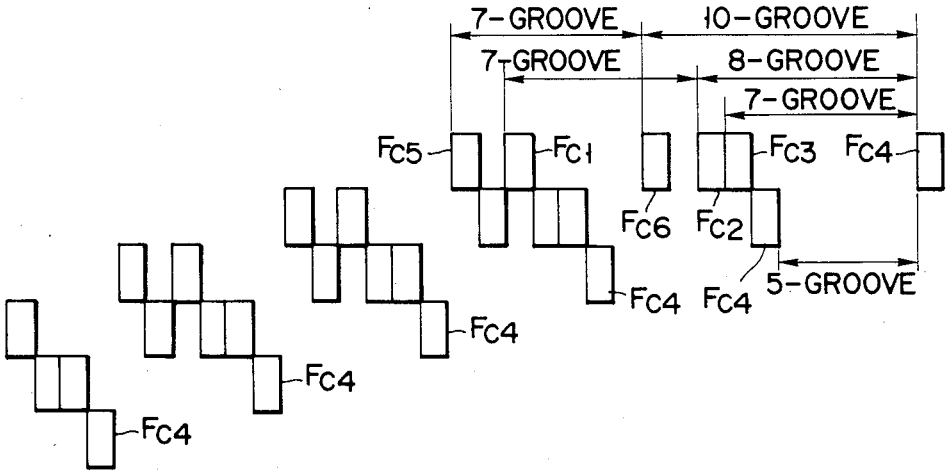
FIG. 17 is a diagram explaining how the filter tips are supplied one after another in the filter-supplying section shown in FIG. 16.

FIGS. 16 and 17 show a fourth embodiment of this invention. Filter-supplying section 1 of this embodiment comprises two filter-supplying mechanisms 300*c* and 300*p* which perform the same functions as first and second filter-supplying mechanisms 2*c* and 2*p*, respectively. That is, section 1 of the fourth embodiment is designed to supply dual filter DF to wrapping section 100 (not shown in FIG. 16 or 17). Either filter-supplying mechanism has the same number of grooved drum as its equivalent of the first embodiment, but is different in the following respects. In first filter-supplying mechanism 300*c*, filter-bypassing drum 20*c* is set in rolling contact with filter-transporting drum 15*c*, not with filter-bypassing drum 18*c* as in first filter-supplying mechanism 2*c* of the first embodiment. Further, filter-bypassing drum 18*c* has ten grooves 21. Drum 18*c* bypasses only filter tips Fc5 and Fc6 and fed them back into groove 16 of filter-transporting drum 15*c*. Filter-bypassing drum 20*c* bypasses only filter tips Fc1 and Fc2 and fed them back into groove 16 of filter-transporting drum 15*c*. Filter-bypassing drums 18*p* and 20*p* of second filter-supplying mechanism 300*p* performs functions similar to those of drums 18*c* and 20*c* of mechanism 300*c*.

First filter-supplying mechanisms 300*c* supplies filter tips in such a manner as is illustrated in FIG. 17, and second filter-supplying mechanisms 300*c* supplies filter tips in the same way. As can be clearly understood from FIG. 17, mechanisms 300*c* and 300*p* can supply tip halves Fch and filter tips Fpn into grooves 35 of filter-juxtaposing drum 34, two charcoal tip halves Fch and one plain filter chip Fpn into each groove 35, which will be combined, by wrapping section 100, with two cigarettes into a long filter cigarette twice as long as a filter cigarette of the ordinary length.

Figure 18:
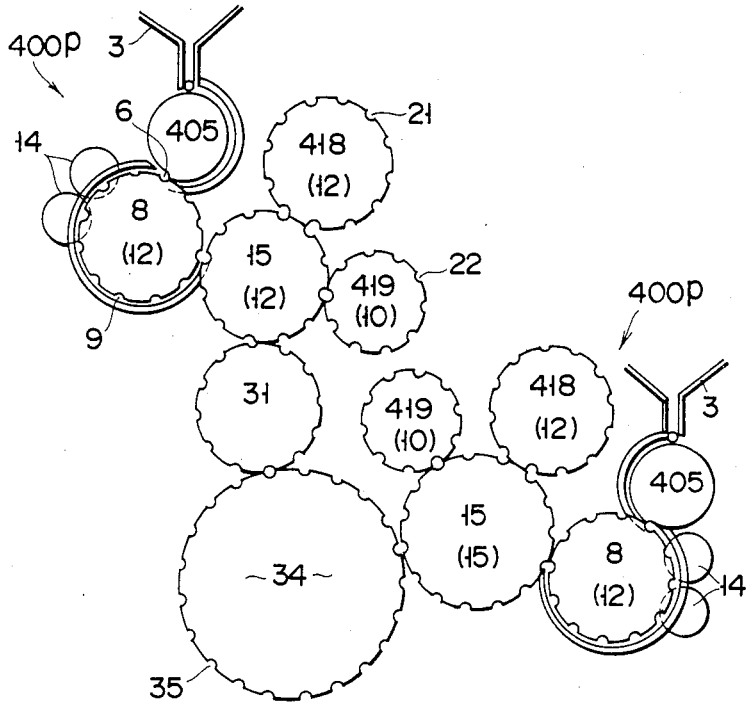
FIG. 18 schematically shows the filter-supplying section of a filter cigarette-manufacturing apparatus according to a fifth embodiment of this invention.
Figure 19:
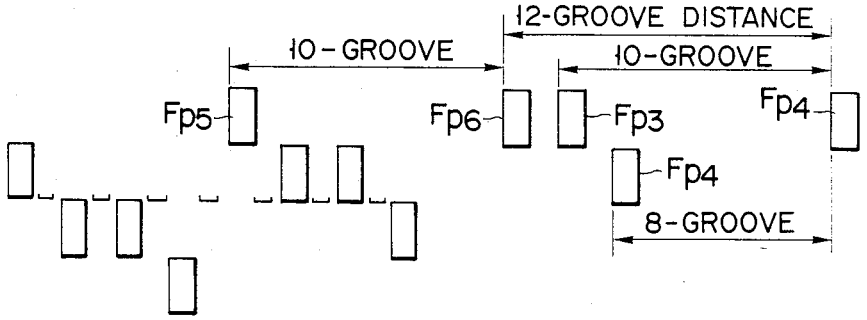
FIG. 19 is a diagram explaining how the filter tips are supplied one after another in the filter-supplying section shown in FIG. 18.

In all embodiments described above, each filter rod is cut into six filter tips, and these tips are supplied to wrapping section 100. The present invention is not limited to these embodiments. FIGS. 18 and 19 show a fifth embodiment of the invention, wherein each filter rod is cut into four filter tips, and these tips are supplied to wrapping section 100. As is shown in FIG. 18, filter-supplying section 1 of the fifth embodiment comprises two filter-supplying mechanisms 400*p*, each for processing plain filter rods Fp. In either mechanism 400*p*, filter-supplying drum 405 takes filter rods Fp from hopper 3 and supplies it into every eighth groove 9 of grooved drum 8. That is, drum 406 has the same diameter as a drum having eight grooves, but has only one groove. Three circular blades 14 are provided for grooved drum 8. These blades 14 correspond to the three of the five circular blades 14 provided for drum 8*c* of the first embodiment (FIG. 1), said three blades 14 for drum 8*c* being located upstream of the remaining two, with respect to the filter-transport path. The three blades 14 are equidistantly spaced along the axis of drum 8. Their edges are inserted in annular grooves 11 cut in the periphery of grooved drum 8, extending in the circumferential direction of drum 8, and spaced at equal intervals along the axis of drum 8, as is illustrated in FIG. 2. Blades 14 therefore cut a plain filter rod Fp, supplied from filter-supplying drum 405 into groove 9 of drum 8, into four filter tips Fpn when this rod Fp is moved to blades 14 as drum 8 rotates forward. More specifically, filter rod Fp is cut into four filter tips Fp3, Fp4, Fp5 and Fp6.

In the fifth embodiment, filter-bypassing drum 418 of either filter-supplying mechanism 400*p* has twelve grooves 21, and filter-bypassing drum 419 of either mechanism 400*p* has ten grooves 22. Drum 418 is used for bypassing filter tip Fp5, and drum 419 is provided for bypassing filter tip Fp6. Either filter-supplying mechanism 400*p* requires no drum equivalent to filter bypassing drum 20c or 20p provided in the first embodiment (FIG. 1).

Each of filter-supplying mechanisms 400p supplies filter tips Fp4 to Fp6 along such a path as is shown in FIG. 19. As can be clearly seen from this figure, each mechanism 400p supplies filter tips Fpn, provided by cutting filter rods Fp, into every other groove 35 of filter-juxtaposing drum 34, in the same way as each filter-supplying mechanism 200p of the third embodiment (FIG. 13). Thus, the tips Fpn supplied from first filter-supplying mechanism 400p, and the tips Fpn supplied form second filter-supplying mechanism 400p, are received in the alternate grooves 35 of filter-juxtaposing drum 34. All these tips Fpn are, therefore, supplied sequentially from drum 34 into all grooves 47 of filter-aligning drum 46 (not shown) of wrapping section 100 (not shown, either).

The present invention is not limited to the embodiments described above. For instance, each filter rod can be cut into an odd number of filter tips, not into an even number of filter tips as in all embodiments described above. Needless to say, various changes and modifications can be made without departing from the spirit and scope of the present invention.

As has been described above, in the apparatus of this invention, all grooved drums of any filter-supplying mechanism are rotated at the same circumferential speed. Therefore, not only is it sufficient to use a drive mechanism of a relatively simple structure to rotating these drum, but also is to easy to adjust the circumferential speed of these drums. Moreover, when one of the two filter-supplyings mechanisms is used to supply plain tips, and the other filter-supplying mechanism is employed to supply charcoal filter tips, the apparatus can manufacture dual-filter cigarettes with a high productivity, without requiring a dual filter-producing device which is indispensable to the conventional apparatuses for manufacturing dual-filter cigarettes. Furthermore, when only one of the grooved drums of the filter-supplying mechanism, designed for supplying charcoal filter tips, is replaced by a drum having a different number of grooves, this mechanism can be used to supply plain filter tips. In this case, the apparatus can manufacture plain-filter cigarettes at a rate twice higher than the rate at which it can produce dual-filter cigarettes. Hence, the apparatus of the invention can be versatile.

What is claimed is:

1. An apparatus for manufacturing filter cigarettes comprising:

a filter-supplying drum having a periphery and grooves cut in the periphery, extending parallel to the axis of the drum, and spaced at equal intervals along the periphery, said filter-supplying drum being adapted to rotate at a predetermined circumferential speed;

a filter rod-supplying mechanism for supplying filter rods into every Nth groove of said filter-supplying drum, where N is an integer greater than 1;

a filter rod-cutting mechanism provided in a path through which the filter rods are supplied from said filter rod-supplying mechanism to said filter-supplying drum, for cutting each of the filter rods into a plurality of filter tips;

a filter tip-bypassing mechanism comprising a set of tip-bypassing drums, each having a periphery and grooves cut in the periphery, extending parallel to the axis of the drum, and spaced along the periphery at the same intervals as the grooves of said filter-supplying drum, and each being adapted to rotate at the same circumferential speed as said filter-supplying drum, each of said filter tip-bypassing drums being set in rolling contact with said filter-supplying drum and/or with the other tip-bypassing drum set in rolling contact with said filter-supplying drum, and said filter tip-bypassing drums cooperating with said filter-supplying drum such that one of the filter tips obtained by cutting each filter rod and held in the groove of said filter-supplying drum is transported forward as said filter-supplying drum rotates, and that a plurality of by-paths are provided for bypassing the others of these filter tips and feeding them back to the grooves of said filter-supplying drum, thereby spacing them from the one filter tip by different distances defined by different numbers of grooves along the periphery of said filter-supplying drum, and then the others of these filter tips are transported forward as said filter-supplying drum rotates, whereby the filter tips obtained by cutting the filter rods are sequentially distributed into all grooves of said filter-supplying drum that are located downstream of said filter tip-bypassing drums with respect to the by-paths through which said tip-bypassing drums transfer the filter tips; and a wrapping mechanism for receiving the filter tips from said filter-supplying drum and also cigarettes from an external device, and for wrapping a piece of tip paper around each filter tip, thereby forming one filter cigarette twice as long as a filter cigarette having a desired length.

2. An apparatus for manufacturing filter cigarettes, comprising:

a plurality of filter-supplying drums, each having a periphery and grooves cut in the periphery, extending parallel to the axis of the drum, and spaced at equal intervals along the periphery, said filter-supplying drums being adapted to rotate at a predetermined circumferential speed;

a plurality of filter rod-supplying mechanisms provided for said filter-supplying drums, respectively, each being used to supply filter rods into every Nth groove of the corresponding filter-supplying drum, where N is an integer greater than 1;

a plurality of rod-cutting mechanisms provided for said filter-supplying drums, respectively, each located in a path through which the filter rods are supplied from the corresponding filter rod-supplying mechanisms to the corresponding filter-supplying drum, for cutting each of the filter rods into a plurality of filter tips;

a plurality of filter tip-bypassing mechanisms, each comprising sets of tip-bypassing drums, each drum having a periphery and grooves cut in the periphery, extending parallel to the axis of the drum, and spaced along the periphery at the same intervals as the grooves of the said filter-supplying drums, and each being adapted to rotate at the same circumferential speed as said filter-supplying drums;

each of tip-bypassing drums being set in rolling contact with the corresponding filter-supplying drum and/or with the other tip-bypassing drum set in rolling contact with said filter-supplying drum, each set of said tip-bypassing drums cooperating with the corresponding filter-supplying drum such that one of the filter tips obtained by cutting each filter rod and held in the groove of said filter-supplying drum is transported forward as said filter-supplying drum rotates, and that a plurality of by-paths for bypassing the others of these filter tips and feeding them back to the grooves of said filter-supplying drum, thereby spacing them from the one filter tip by different distances defined by different number of grooves along the periphery of said filter-supplying drum, and then the other of these filter tips are transported forward as said filter-supplying drum rotates, whereby the filter tips obtained by cutting the filter rods are sequentially distributed into all grooves of said filter-supplying drum that are located downstream of the set of said tip-bypassing drums with respect to the by-paths through which said tip-bypassing drums transfer the filter tips;

a filter-juxtaposing drum for said filter tip-supplying drums, and having a periphery and grooves cut in the periphery, extending parallel to the axis of the drum, and spaced along the periphery at the same intervals as the grooves of said filter-supplying drums, and being adapted to rotate at the same circumferential speed as said filter-supplying drums, and to receive the filter tips from said filter-supplying drums, juxtapose these filter tips in all grooves, and transport these filter tips forward as said filter-juxtaposing drum rotates; and a wrapping mechanism for receiving the filter tips from said filter-juxtaposing drum and also cigarettes from and external device, and for wrapping a piece of tip paper around each filter tip and two cigarettes axially aligned with the filter tip, thereby forming one filter cigarette twice as long as a filter cigarette having a desired length.

3. An apparatus for manufacturing filter cigarettes comprising:

a first filter-supplying drum having a periphery and grooves cut in the periphery, extending parallel to the axis of the drum, and spaced at equal intervals along the periphery, said first filter-supplying drum being adapted to rotate at a predetermined circumferential speed;

a first filter rod-supplying mechanism for supplying filter rods of a first type into every Nth groove of said first filter-supplying drum, where N is an integer greater than 1;

a first filter rod-cutting mechanism provided in a path through which the filter rods of the first types are supplied from said first filter rod-supplying mechanism to said first filter-supplying drum, for cutting each of the filter rods of the first type into a plurality of filter tips;

a first filter tip-bypassing mechanism comprising a set of first tip-bypassing drums, each having a periphery and grooves cut in the periphery, extending parallel to the axis of the drum, and spaced along the periphery at the same intervals as the grooves of said first filter-supplying drum, and each being adapted to rotate at the same circumferential speed as said first filter-supplying drum, each of said first filter tip-bypassing drums being set in rolling contact with said first filter-supplying drum and/or with the other tip-bypassing drum set in rolling contact with said first filter-supplying drum, and said first filter tip-bypassing drums cooperating with said first filter-supplying drum such that one of the filter tips obtained by cutting each filter rod of the first type and held in the groove of said first filter-supplying drum is transported forward as said first filter-supplying drum rotates, and that a plurality of first by-paths are provided for bypassing the others of these filter tips of the first type and feeding them back to the grooves of said first filter-supplying drum, thereby spacing them from the one filter tip of the first type by different distances defined by different numbers of grooves along the periphery of said first filter-supplying drum, and then the others of these filter tips of the first type are transported forward as said first filter-supplying drum rotates, whereby the filter tips obtained by cutting the filter rods of the first type are sequentially distributed into all grooves of said first filter-supplying drum that are located downstream of said first filter tip-bypassing drums with respect to the first by-paths through which said first tip-bypassing drums transfer the filter tips; and a second filter-supplying drum having a periphery and grooves cut in the periphery, extending parallel to the axis of the drum, and spaced at equal intervals along the periphery, said second filter-supplying drum being adapted to rotate at a predetermined circumferential speed;

a second filter rod-supplying mechanism for supplying filter rods of a second type into every Nth groove of said second filter-supplying drum, where N is an integer greater than 1;

a second filter rod-cutting mechanism provided in a path through which the filter rods of the second type are supplied from said second filter rod-supplying mechanism to said second filter-supplying drum, for cutting each of the filter rods of the second type into a plurality of filter tips;

a second filter tip-bypassing mechanism comprising a set of second tip-bypassing drums, each having a periphery and grooves cut in the periphery, extending parallel to the axis of the drum, and spaced along the periphery at the same intervals as the grooves of said second filter-supplying drum, and each being adapted to rotate at the same circumferential speed as said second filter-supplying drum, each of said second filter tip-bypassing drums being set in rolling contact with said second filter-supplying drum and/or with the other tip-bypassing drum set in rolling contact with said second filter-supplying drum, and said second filter tip-bypassing drums cooperating with said second filter-supplying drum such that one of the filter tips obtained by cutting each filter rod of the second type and held in the groove of said second filter-supplying drum is transported forward as said second filter-supplying drum rotates, and that a plurality of second by-paths are provided for bypassing the others of these filter tips of the second type and feeding them back to the grooves of said second filter-supplying drum, thereby spacing them from the one filter tip of the second type by different distances defined by different numbers of grooves along the periphery of said second filter-supplying drum, and then the other of these filter tips of the second type are transported forward as said second filter-supplying drum rotates, whereby the filter tips obtained by cutting the filter rods of the second type are sequentially distributed into all grooves of said second filter-supplying drum that are located downstream of said second filter tip-bypassing drums with respect to the second by-paths through which said second tip-bypassing drums transfer the filter tips; and a filter-juxtaposing drum for said first and second filter tip-supplying drums, and having a periphery and grooves cut in the periphery, extending parallel to the axis of the drum, and spaced along the periphery at the same intervals as the grooves of said first and second filter-supplying drums, and being adapted to rotate at the same circumferential speed as said first and second filter-supplying drums, and to receive the filter tips of the first type from said first filter-supplying drum and also the filter tips of the second type from said second filter-supplying drum juxtapose these filter tips in all grooves such that one filter tip of the first type and one filter tip of the second type are placed in each groove;

a filter-cutting/separating mechanism provided in a path through which the filter tips of the first type are supplied from said first filter-supplying drum to said filter-juxtaposing drum, and adapted to cut each of filter tip of the first type into two tip halves and separate these tip halves, thereby forming a prescribed gap between the tip halves, so that each filter tip of the second type is inserted in this gap when the filter tip of the first type and the filter tip of the second type are supplied into the groove of said filter-juxtaposing drum, thereby to form a dual filter tip; and a wrapping mechanism for receiving each dual filter tip from said filter-juxtaposing drum and also cigarettes form an external device, and for wrapping a piece of tip paper around the dual filter tip and two cigarettes axially aligned with the dual filter tip, thereby forming one filter cigarette twice as long as a filter cigarette having a desired length.

4. An apparatus according to claim 3, wherein said filter-cutting/separating mechanism comprises rotatable circular blade arranged in the path through which the filter tips of the first type are supplied from said first filter-supplying drum to said filter-juxtaposing drum, and adapted to cut each of the filter tips of the first type being supplied through said path into two tip halves; and a suction unit provided in said path for attracting the two tip halves away from each other in the axial direction thereof, by means of air streams.

5. An apparatus according to claim 4, wherein said suction unit is positioned, overlapping said circular blade.

6. An apparatus according to claim 5, wherein said filter-juxtaposing drum has a guide extending along the periphery of said drum for separating said two tip halves to provide a gap slightly longer than the length of the second filter tip while said two tip halves are received in the groove as said filter-juxtaposing drum is rotated.

* * * * *